US007976652B2

(12) United States Patent
Sakai et al.

(10) Patent No.: US 7,976,652 B2
(45) Date of Patent: Jul. 12, 2011

(54) METHOD FOR PRODUCING BERYLLIUM-COPPER

(75) Inventors: Taku Sakai, Chofu (JP); Naokuni Muramatsu, Nagoya (JP); Koki Chiba, Handa (JP)

(73) Assignee: NGK Insulators, Ltd., Nagoya (JP)

( * ) Notice: Subject to any disclaimer, the term of this patent is extended or adjusted under 35 U.S.C. 154(b) by 865 days.

(21) Appl. No.: 11/860,822

(22) Filed: Sep. 25, 2007

(65) Prior Publication Data

US 2008/0078485 A1 Apr. 3, 2008

Related U.S. Application Data

(63) Continuation of application No. PCT/JP2006/305726, filed on Mar. 22, 2006.

(30) Foreign Application Priority Data

Mar. 29, 2005 (JP) ..... 2005-096442

(51) Int. Cl.
*C22F 1/08* (2006.01)
*C22C 9/00* (2006.01)

(52) U.S. Cl. ..... 148/685; 148/646

(58) Field of Classification Search ..... 148/646, 148/685

See application file for complete search history.

(56) References Cited

U.S. PATENT DOCUMENTS

| | | | | |
|---|---|---|---|---|
| 2,550,474 | A * | 4/1951 | Harrington | 148/607 |
| 4,533,412 | A * | 8/1985 | Rotem | 148/411 |
| 4,792,365 | A | 12/1988 | Matsui et al. | |
| 5,131,958 | A | 7/1992 | Sakai et al. | |

FOREIGN PATENT DOCUMENTS

| | | | |
|---|---|---|---|
| EP | 0 271 991 | A2 | 6/1988 |
| JP | 56-163248 | A1 | 12/1981 |
| JP | 59-225840 | A1 | 12/1984 |
| JP | 62-199743 | A1 | 9/1987 |
| JP | 63-114929 | A1 | 5/1988 |
| JP | 02-243748 | A1 | 9/1990 |
| JP | 04-187351 | A1 | 7/1992 |
| JP | 10-296398 | A1 | 11/1998 |

* cited by examiner

*Primary Examiner* — Sikyin Ip
(74) *Attorney, Agent, or Firm* — Burr & Brown

(57) ABSTRACT

A method for producing beryllium-copper containing at least Be and Cu, includes holding the beryllium-copper for a predetermined solid solution time in a solid solution temperature range in which the Be is dissolved into the Cu, cooling the beryllium-copper at a cooling speed at which the Be remains dissolved in the Cu, applying plastic strain to a cooled beryllium-copper over multiple times in a processing temperature range in which the Be is not precipitated, and holding the beryllium-copper for a predetermined age hardening time in a precipitation temperature range in which the Be is precipitated.

4 Claims, 11 Drawing Sheets

(a)

ε = 0

(b)

ε = 0.4

(c)

ε = 1.6

(d)

ε = 3.6

(e)

ε = 4.8

(f)

ε = 6.0

METHOD FOR PRODUCING BERYLLIUM-COPPER

CROSS REFERENCE TO RELATED APPLICATIONS

The present application is a continuation of International application No. PCT/JP2006/305726, filed on Mar. 22, 2006, which claims benefit of priority under 35 USC 119 based on Japanese Patent Applications No. P2005-096442, filed on Mar. 29, 2005; the entire contents of which are incorporated herein by reference.

BACKGROUND OF THE INVENTION

1. Field of the Invention

The present invention relates to beryllium-copper which contains at least Be and Cu and has plastic strain added thereto, a method for producing the beryllium-copper, and an apparatus for producing the beryllium-copper.

2. Description of the Related Art

Precipitation type copper alloy containing beryllium (Be) (hereinafter referred to as beryllium-copper) has been generally and widely used as a high strength spring material, a conductive material, or the like.

When beryllium-copper is cold processed (at ambient temperature) by casting, rolling, pressing, and the like (hereinafter referred to as casting processing or the like), work hardening advances remarkably. Therefore, it is difficult to process beryllium-copper into desired dimensions by performing casting processing or the like once.

Therefore, beryllium-copper is generally hot-processed (at high temperature) by casting processing or the like (for example, refer to Japanese Patent Publication No. 2088889 (claim 1, FIG. 1, and so forth)).

To be specific, beryllium-copper is processed under processing conditions of specific processing temperature (600° C. to 800° C.) a specific processing speed (3.3×10-5S-1 to 1×10S-1), a specific amount of working strain (0.20 or larger), and the like, and uniform and fine crystal grains are formed into beryllium-copper.

However, in the conventional technology, since a crystal grain is micronized by utilizing dynamic recrystallization which is induced by performing hot processing (at high temperature) to beryllium-copper, the crystal grain of beryllium-copper has only been micronized down to in the order of 30 μm.

Here, if considerable strain can be applied to beryllium-copper, there is a possibility of gaining a fine crystal grain by an HPT (high pressure torsion) method, an ECAE (equal channel angular extrusion) method, an ARB (accumulative roll bonding) method, and the like, which however has not been appropriate for industrial use.

The HTP method is a method where a large shear deformation is made in a small disc-shaped test piece by torsional deformation while applying large pressure to the test piece. Also, the ECAE method is a method where a material is repeatedly passed through dies which have a constant cross sectional area and a bend portion so as to add a simple shear deformation to the bend portion.

To be more specific, with the HPT method, because an amount of strain varies depending on a distance from the center of a disc-shaped test piece (a position in the radius direction), uniform crystal grains cannot be obtained. With the ECAE method, since life of dies is short, it is not appropriate for mass production. Moreover, the ECAE method is not appropriate for continuous production of large-sized structural materials in an industrial scale either. With the ARB method, as work hardening is large, it is difficult to process a material under a massive pressure for each pass. Further, with the ARB method, bonding is prevented as an oxide film is created by active elements of Be and the like.

Also, in the method stated in Patent Document 1, since beryllium-copper is hot-processed (at high temperature), an oxidized scale is generated in beryllium-copper, and work need to be done to remove the generated oxidized scale.

Here, a method which can be considered is the one for processing beryllium-copper at specific processing temperature for specific processing time (for example, temperature of 300° C. and time of 30 minutes or shorter) with which an oxidized scale is not generated in beryllium-copper and age hardening of beryllium-copper does not progress. However, because beryllium-copper should be processed while strictly controlling the processing time and processing temperature, it is difficult to put this method into practice.

SUMMARY OF THE INVENTION

A first aspect of the present invention inheres in a beryllium-copper containing at least Be and Cu, encompassing crystal grains whose average grain size is 2 μm or smaller, and a precipitated phase which contains at least the Be precipitated from the Cu.

According to the first, aspect of the present invention, strength and bendability of beryllium-copper improve by making an average grain size of crystal grains of beryllium-copper to 2 μm or smaller. In other words, reliability of beryllium-copper improves.

A second aspect of the present invention inheres in the beryllium-copper according to the first aspect, wherein the beryllium-copper is structured with a weight ratio of $Cu_{100-(a-b)}Be_aCo_b$ ($0.4\% \leqq a \leqq 2.0\%$, $0.15\% \leqq b \leqq 2.8\%$, and $a+b \leqq 3.5\%$), or a weight ratio of $Cu_{100-(C-d)}Be_cNi_d$ ($0.05\% \leqq c \leqq 0.6\%$, $1.0\% \leqq d \leqq 2.4\%$, and $c+d \leqq 3.0\%$).

A third aspect of the present invention inheres in the beryllium-copper according to the first aspect, wherein the beryllium-copper is formed by holding the beryllium-copper for a predetermined solid solution time in a solid solution temperature range in which Be is dissolved into the Cu; cooling the beryllium-copper at a cooling speed at which the Be remains dissolved in the Cu; applying plastic strain to a cooled beryllium-copper over multiple times in a processing temperature range in which the Be is not precipitated; and holding the beryllium-copper to which the plastic strain is applied for a predetermined age hardening time in a precipitation temperature range in which the Be is precipitated.

A fourth aspect of the present invention inheres in the beryllium-copper according to the first aspect, wherein the average grain size of the crystal grains is calculated by a crystal orientation analysis method, the crystal orientation analysis method encompassing obtaining a crystal grain size distribution by counting a boundary with an orientation deviation θ of 2° or larger as a crystal grain boundary by using a Scanning Electron Microscope/Electron Back Scatter Diffraction Pattern method; confirming that an average orientation deviation θ of a total count is 15° or larger; and calculating the average grain size from the crystal grain size distribution.

A fifth aspect of the present invention inheres in a method for producing beryllium-copper which contains at least Be and Cu, encompassing holding the beryllium-copper for a predetermined solid solution time in a solid solution temperature range in which Be is dissolved into the Cu; cooling the beryllium-copper at a cooling speed at which the Be remains dissolved in the Cu; applying plastic strain to a cooled beryllium-copper over multiple times in a processing temperature range in which the Be is not precipitated; and holding the beryllium-copper to which the plastic strain is applied for a predetermined age hardening time in a precipitation temperature range in which the Be is precipitated.

According to the fifth aspect of the present invention, by adding plastic strain to the beryllium-copper within a processing temperature range in which Be is not precipitated, generation of an oxidized scale can be suppressed.

Moreover, by applying the plastic strain to beryllium-copper over multiple times, an amount of plastic strain applied to the beryllium-copper (an accumulated amount of strain) is increased without strictly controlling processing temperature and processing time, thus producing the beryllium-copper having uniform and fine crystal grains.

Furthermore, by applying the plastic strain to the beryllium-copper before an age hardening is performed, a difficulty in adding plastic strain as working hardening advances can be avoided.

A sixth aspect of the present invention inheres in the method according to the fifth aspect, wherein the beryllium-copper is structured with a weight ratio of $Cu_{100-(a-b)}Be_aCo_b$ ($0.4\% \leqq a \leqq 2.0\%$, $0.15\% \leqq b \leqq 2.8\%$, and $a+b \leqq 3.5\%$), or a weight ratio of $Cu_{100-(c-d)}Be_cNi_d$ ($0.05\% \leqq 0.6\%$, $1.0\% \leqq d \leqq 2.4\%$, and $c+d \leqq 3.0\%$).

A seventh aspect of the present invention inheres in the method according to the fifth or sixth aspect, wherein the solid solution temperature range is within a range from 700° C. to 1000° C., the predetermined solid solution time is within a range from 1 hour to 24 hours, the processing temperature range is within a range from 0° C. to 200° C., the precipitation temperature range is within a range from 200° C. to 550° C., and the predetermined age hardening time is within a range from 1 hour to 24 hours.

A eighth aspect of the present invention inheres in the method according to any one of the fifth through seventh aspect, wherein holding the beryllium-copper to which the plastic strain is applied is a rectangular parallelepiped having sides which extend in directions of three axes which are orthogonal to each other, and the applying step includes applying pressure to the beryllium-copper from each of the directions of the axes by turns.

A ninth aspect of the present invention inheres in the method according to the eighth aspect, wherein the beryllium-copper to which the plastic strain is applied has a shape of a rectangular parallelepiped in which a ratio of lengths of the sides extending in the directions of the three axes which are orthogonal to each other is 1:e:f ($1.2 \leqq e \leqq 1.3$, $1.45\% \leqq f \leqq 1.55$), and an amount of the plastic strain which can be applied to the beryllium-copper by single pressurization is within a range from 0.3 to 0.7.

A tenth aspect of the present invention inheres in the method according to the eighth or ninth aspect, wherein the applying step further includes applying pressure to the beryllium-copper from each of the direction of the axes by turns until an accumulated value of the plastic strain applied to the beryllium-copper becomes 4 or more.

An eleventh aspect of the present invention inheres in an apparatus for producing the beryllium-copper which contains at least Be and Cu, encompassing a mounting portion having a placement surface on which a rectangular copper alloy in which the Be is dissolved in the Cu is placed; a heater portion configured to heat the rectangular copper alloy placed on the placement surface of the mount portion; and a pressurizing portion facing the placement surface of the mount portion, and applies pressure to the rectangular copper alloy placed on the placement surface of the mount portion, wherein the heater portion keeps environmental temperature of the rectangular copper alloy within a processing temperature range in which Be is not precipitated, and the pressurizing portion applies plastic strain to the rectangular copper alloy for multiple times within the processing temperature range.

DETAILED DESCRIPTION OF THE INVENTION

Figure 1:
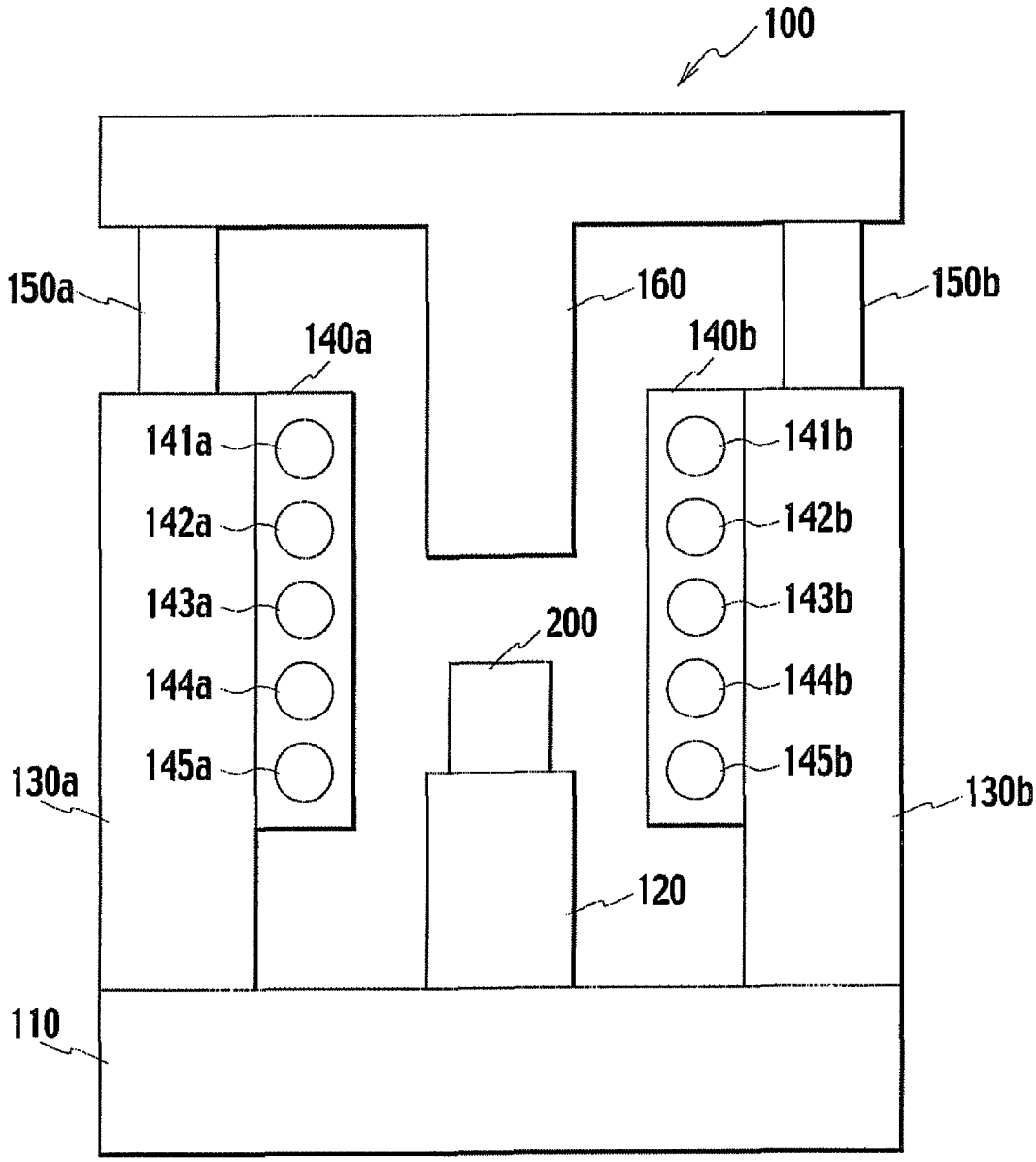
FIG. 1 is a view illustrating a structure of a casting apparatus 100 according to an embodiment of the present invention.

Outline of a Production Apparatus According to an Embodiment of the Present Invention Herein below, the outline of a production apparatus according to an embodiment of the present invention is described with reference to drawings. FIG. 1 is a view showing a structure of a casting apparatus 100 according to the embodiment of the present invention.

The casting apparatus 100 is an apparatus for applying plastic strain to rectangular copper alloy by adding a pressure to the rectangular copper alloy which contains at least small amounts of Be and Cu and has a rectangle shape. The details of the rectangular copper alloy will be described later (refer to FIG. 3).

Here, the casting apparatus 100 processes copper alloy to which a solid solution processing has been conducted. Here, the solid solution processing refers to a process where copper alloy containing at least small amounts of Be and Cu is held under heating in a solid solution temperature range (within a range from 700° C. to 1000° C.) for predetermined solid solution holding time (1 to 24 hours), and the copper alloy is then cooled by water hardening or the like so that a cooling speed is −100° $C.s^{-1}$ or higher (preferably −200° $C.s^{-1}$ or higher). In other words, the casting apparatus 100 processes the rectangular copper alloy in which Be (or Be compound) is dissolved into a Cu matrix and dislocation of crystal grains have not occurred.

As shown in FIG. 1, the casting apparatus 100 includes a base portion 110, a mount portion 120, a pair of support column portions 130 (a support column portion 130*a* and a support column portion 130*b*), a pair of heater portions 140 (a heater portion 140*a* and a heater portion 140*b*), a pair of extendable portions 150 (an extendable portion 150*a* and an extendable portion 150*b*), and a pressurizing portion 160.

The base portion 110 supports the support column portion 130*a* and the support column portion 130*b*. The mount portion 120 has a column-like shape and is provided on the base portion 110. Further, the mount portion 120 supports a rectangular copper alloy 200 to be processed by the casting apparatus 100.

The support column portion 130*a* and the support column portion 130*b* have a column-like shape, and are provided on the base portion 110. Further, the support column portion 130*a* has a structure which allows the extendable portion 150*a* to be extended and contracted in the vertical direction (for example, a structure where the extendable portion 150*a* is extended and contracted by hydraulic pressure or the like). Similarly, the support column portion 130*b* has a structure which allows the extendable portion 150*b* to be extended and contracted in the vertical direction.

The heater portion 140*a* is provided on a side surface of the support column portion 130*a*, and has a plurality of heat sources (a heat source 141*a* to a heat source 145*a*) which apply heat to the rectangular copper alloy 200. Similarly, the heater portion 140*b* is provided on a side surface of the support column portion 130*b*, and has a plurality of heat sources (a heat source 141*b* to a heat source 145*b*) which apply heat to the rectangular copper alloy 200.

The extendable portion 150*a* and the extendable portion 150*b* support the pressurizing portion 160, and extend and contract in the vertical direction. The pressurizing portion 160 applies pressure to the rectangular copper alloy 200 and deforms the rectangular copper alloy 200.

(Outline of a Production Apparatus According to the Embodiment of the Present Invention)

Figure 2:
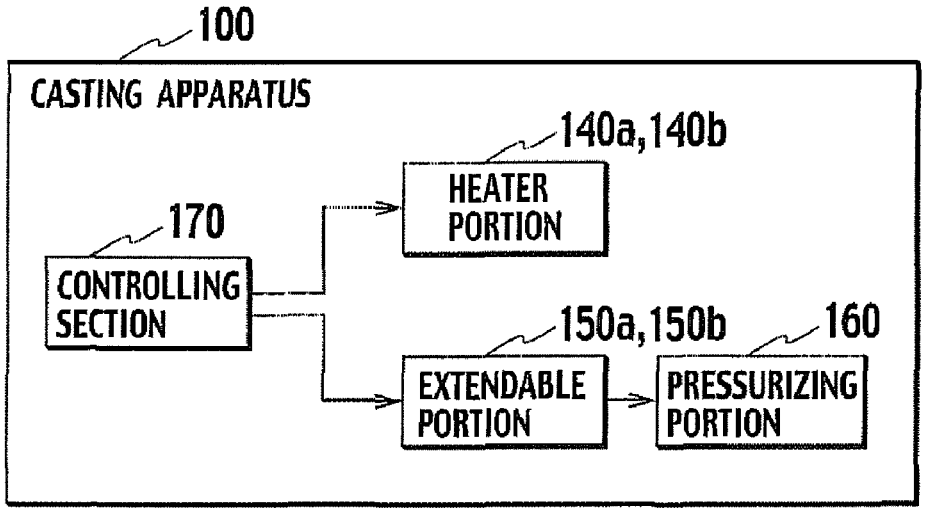
FIG. 2 is a block view illustrating functions of the casting apparatus 100 according to the embodiment of the present invention.

Hereinafter, functions of the casting apparatus 100 according to the embodiment of the present, invention are described with reference to the drawing. FIG. 2 is a block view showing functions of the casting apparatus 100 according to the embodiment of the present invention.

As shown in FIG. 2, the casting apparatus 100 includes a controlling section 170 in addition to the heater portions 140, the extendable portions 150, and the pressurizing portion 160.

The controlling section 170 controls the heater portions 140 and the extended portions 150. To be more specific, the control section 170 controls the heater portions 140 so that inside temperature the casting apparatus 100 (the environmental temperature of the rectangular copper alloy 200) is between 0° C. and 200° C. Further, the controlling section 170 allows the extendable portion 150 to extend and contract so that a speed of plastic strain applied to the rectangular copper alloy 200 (hereinafter referred to as strain speed) is $1\times10^{-3}s^{-1}$ to $1\times10^{-1}x^{-1}$ (preferably, $1\times10^{-2}s^{-1}$ to $1\times10^{-1}x^{-1}$).

(Structure of Beryllium-Copper According to the Embodiment of the Present Invention)

Figure 3:
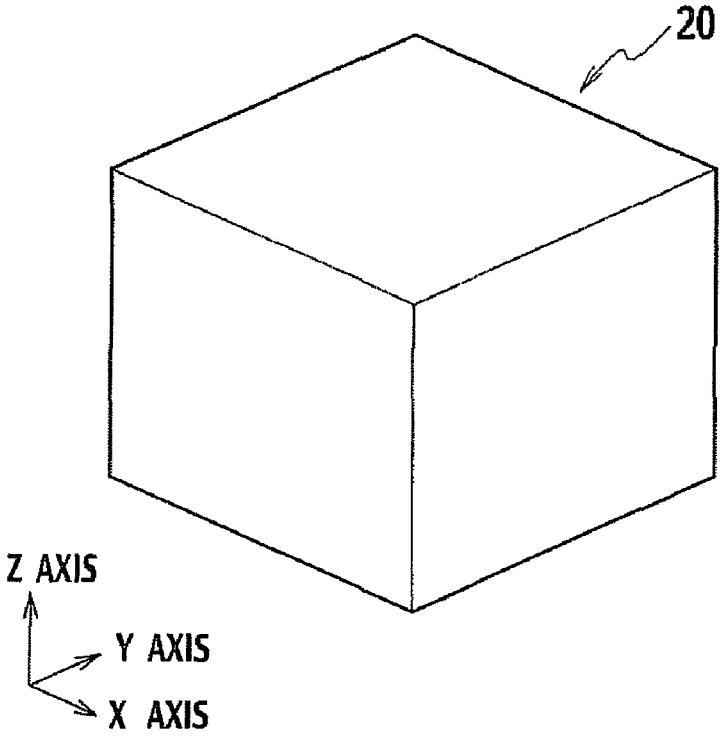
FIG. 3 is a view illustrating the rectangular copper alloy 200 according to the embodiment of the present invention.

Herein below, a target object to be processed (beryllium-copper) according to the embodiment of the present invention will be described with reference to the drawing. FIG. 3 is a view showing the rectangular copper alloy 200 according to the embodiment of the present invention.

As shown in FIG. 3, the rectangular copper alloy 200 is a rectangular parallelepiped (the rectangular copper alloy) having sides extending along directions of three axes (X axis, Y axis, and Z axis) which are orthogonal to each other. Also, a ratio of lengths of the sides extending in the directions of the three axes (X side:Y side:Z side) is 1:e:f (however $1.2<e<1.3$, $1.45<f<1.55$). Preferably, the ratio of lengths of the sides (X side:Y side:Z side) is 1:1.22:1.5 (this means e=1.22, f=1.5.).

Also, the rectangular copper alloy 200 is structured with a weight ratio of (1) $Cu_{200-(a-b)}Be_aCo_b$ ($0.4\%\leqq a\leqq 2.0\%$, $0.15\%\leqq b\leqq 2.8\%$, and $a+b\leqq 3.5\%$), or (2) $Cu_{100-(c-d)}Be_cNi_d$ ($0.05\%\leqq c\leqq 0.6\%$, $1.0\%\leqq d\leqq 2.4\%$, and $c+d\leqq 3.0\%$).

Here, the reason why the combination of (1) is used as the weight ratio of the rectangular copper alloy 200 is as follows. A reason why the weight ratio of Be is 0.4% or higher is to improve the strength by using a precipitated phase structured by Be and CU and/or Be and Co, and a reason why the weight ratio of Be is 2.0% or lower is to improve the strength by suppressing coarsening of a precipitated phase structured by Be and Co. Also, a reason why the weight ratio of Co is 0.15% or higher is to improve the strength by adding Co, and a reason why the weight ratio of Co is 2.8% or lower is to suppress coarsening of a precipitated phase structured by Be and Co.

On the other hand, a reason why the combination of (2) is used as a weight ratio of the rectangular copper alloy 200 is to reduce the weight ratio of Be by adding Ni for cost reduction as Ni is cheaper than Be.

Specifically, a reason why the weight ratio of Be is 0.05% is to improve the strength by using a precipitated phase structured by Be and Ni. A reason why the weight ratio of Be is 0.6% or lower is to obtain a sufficient effect of cost reduction by reducing the weight ratio of Be. Furthermore, a reason why the weight ratio of Ni is 1.0% or higher is to improve the strength by adding Ni, and a reason why the weight ratio of Ni is 2.4% or lower is to suppress a decrease of conductivity and an increase in a melting point due to Ni contained in Cu matrix.

(Method for Producing Beryllium-Copper According to the Embodiment of the Present Invention)

Figure 4:
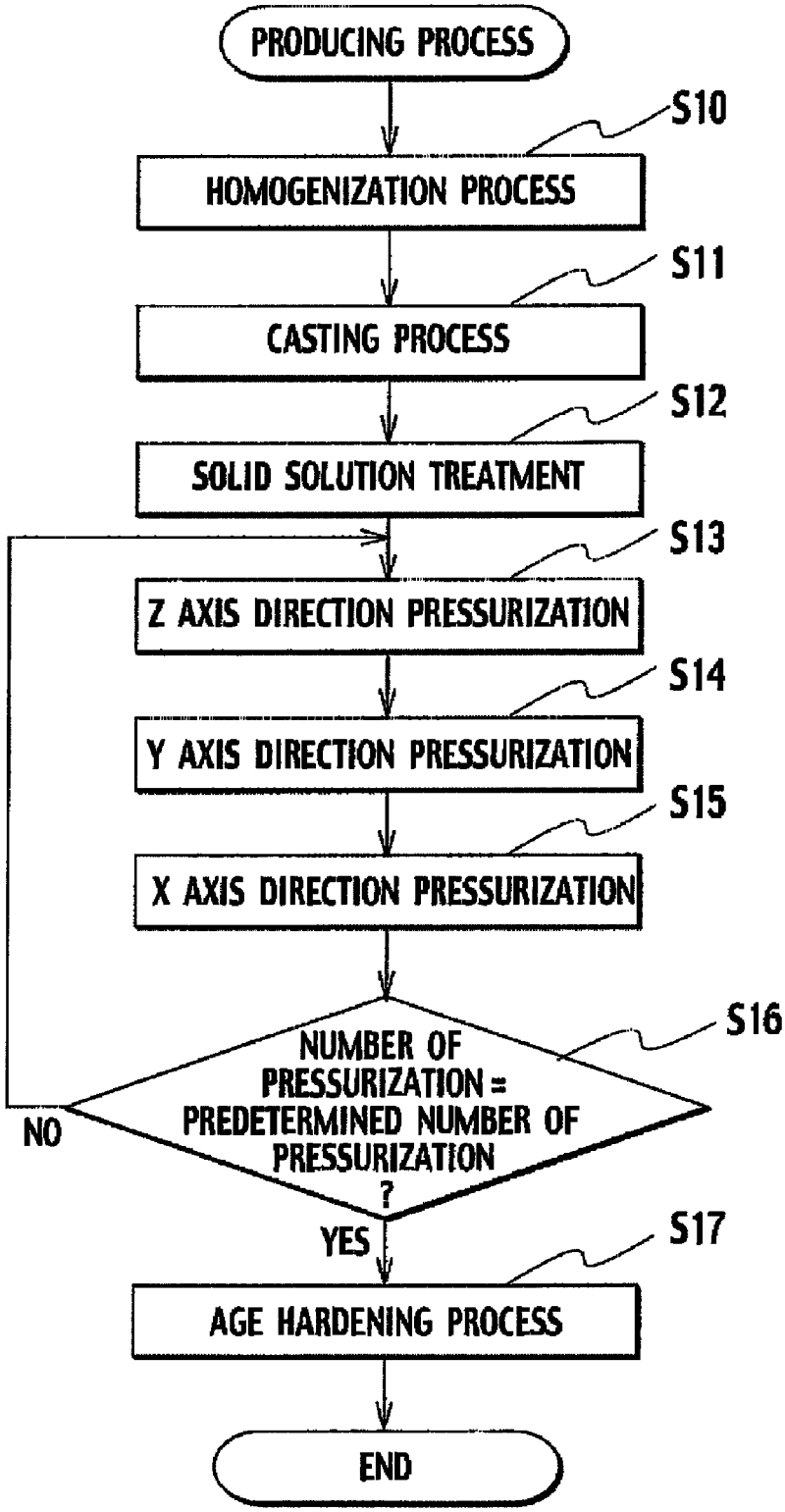
FIG. 4 is a flowchart illustrating a method for producing the beryllium-copper according to the embodiment of the present invention.

Herein below, a method for producing the beryllium-copper according to the embodiment of the present invention is described with reference to the drawing. FIG. 4 is a flowchart showing a method for producing the beryllium-copper according to the embodiment of the present invention.

As shown in FIG. 4, in step 10, Be (or Be compound) is dissolved into the Cu matrix by homogenization processing, generating copper alloy in which dislocation of crystal grains have not occurred.

Specifically, by melting copper alloy structured with the weight ratio of $Cu_{100-(a-b)}Be_aCo_b$ ($0.4\%\leqq a\leqq 2.0\%$, $0.15\%\leqq b\leqq 2.8\%$, and $a+b\leqq 3.5\%$) or the weight ratio of $Cu_{100-(c-d)}Be_cNi_d$ ($0.05\%\leqq c\leqq 0.6\%$, $1.0\%\leqq d\leqq 2.4\%$, and $c+d\leqq 3.0\%$) in a high-frequency melting furnace, an ingot of ø200 mm is generated. Further, by holding the generated ingot under heating in a solid solution temperature range (within a range from 700° C. to 1000° C.) for a predetermined holding time (1 hour to 24 hours), non-uniform structures such as segregation which are generated in an unbalanced manner during casting and impose adverse effects to downstream operations are removed, realizing homogenization.

In step 11, the copper alloy containing a small amount of Be is processed into a plate-like copper alloy having a plate-like shape (for example, 13 mm×450 mm×400 mm). Further, an oxide film formed on the surface of the plate-like copper alloy is removed by cutting. Furthermore, the rectangular copper alloy 200, a rectangular parallelepiped having sides which extend in the directions of the three axes (X axis, Y axis, and Z axis) which are orthogonal to each other, is cut out from the plate-like copper alloy. The length ratio of the sides of the rectangular copper alloy 200 (X side:Y side:Z side) is 1:e:f (however, $1.2<e<1.3$, $1.45<f<1.55$).

In step S12, Be (or Be compound) is dissolved into the Cu matrix by solid solution processing. To be more specific, the rectangular copper alloy 200 allows Be (or Be compound) to be dissolved into the C matrix by being held under heating in a solid solution temperature range (within a range from 700° C. to 1000° C.) for the predetermined holding time (1 hour to 24 hours). Also, as this rectangular copper alloy 200 is cooled by water hardening or the like at, a cooling speed of 100° C.$s^{-1}$ or higher (preferably, 200° C.$s^{-1}$ or higher), the rectangular copper alloy 200 becomes a supersaturated solid solution without, precipitation of Be (or Be compound).

In the step S13, pressure is applied from the Z axis direction to the rectangular copper alloy 200 by the casting apparatus 100 described earlier. Here, a strain speed of plastic strain applied to the rectangular copper alloy 200 is within a range from $1\times10^{-3}$ $s^{-1}$ to $1\times10^{-1}$ $s^{-1}$ (preferably, from $1\times10^{-2}$ $s^{-1}$ to $1\times10^{-1}$ $s^{-1}$), and an amount of the plastic strain applied to the rectangular copper alloy 200 (an amount of strain: $\epsilon$) is within a range from 0.3 to 0.7. Further, the rectangular copper alloy 200 is processed in a processing a processing temperature range (within a range form 0° C. to 200° C.).

In step S14, pressure is applied from the Y axis direction to the rectangular copper alloy 200 by the casting apparatus 100 described earlier. Here, a strain speed of plastic strain applied to the rectangular copper alloy 200 is within a range from $1\times10^{-3}$ $s^{-1}$ to $1\times10^{-1}$ $s^{-1}$ (preferably, from $1\times10^{-2}$ $s^{-1}$ to $1\times10^{-1}$ $s^{-1}$), and an amount of the plastic strain applied to the rectangular copper alloy 200 (an amount of strain: $\epsilon$) is within a range from 0.3 to 0.7. Further, the rectangular copper alloy 200 is processed in a processing temperature range (within a range form 0° C. to 200° C.).

In step 15, pressure is applied from the X axis direction to the rectangular copper alloy 200 by the casting apparatus 100 described earlier. Here, a strain speed of plastic strain applied to the rectangular copper alloy 200 is within a range from $1\times10^{-3}$ $s^{-1}$ to $1\times10^{-1}$ $s^{-1}$ (preferably, from $1\times10^{-2}$ $s^{-1}$ to $1\times10^{-1}$ $s^{-1}$), and an amount of the plastic strain applied to the rectangular copper alloy 200 (an amount of strain: $\epsilon$) is within a range from 0.3 to 0.7. Further, the rectangular copper alloy 200 is processed in a processing temperature range (within a range form 0° C. to 200° C.).

This means that, in steps S13 to S15, pressure is applied from the direction of the axis which corresponds to the longest side among the sides of the rectangular copper alloy 200, and the ratio of the sides of the rectangular copper alloy 200 is kept to 1:e:f.

In step S16, an operator determines whether the number of times the rectangular copper alloy 200 is pressurized (the number of pressurization) has reached a predetermined number (for example, 15 times). If the number of pressurization has reached the predetermined number of pressurization, processing of step 17 is performed, and if the number of pressurization has not reached the predetermined number of pressurization, the processing of steps S13 to S15 is conducted again.

In the present embodiment, the number of pressurization is a number which is counted up as one time after pressure is applied to the rectangular copper alloy 200 from any one of directions of the respective axes (X axis, Y axis, and Z axis). Further, the predetermined number of pressurization is a number with which an accumulated value of an amount of plastic strain applied to the rectangular copper alloy 200 (the accumulated amount of strain: $\epsilon_{total}$) is 4 or more.

Also, in this embodiment, it is determined whether the number of pressurization has reached the predetermined number of pressurization or not after the rectangular copper alloy 200 is pressurized from the directions of Z axis, Y axis and Z axis. However, the present invention is not limited to this, and whether the number of pressurization has reached the predetermined number of pressurization or not can be determined every time pressure is applied to the rectangular copper alloy 200.

In Step S17, age hardening processing is performed to the rectangular copper alloy 200, and a precipitated phase structured by Be (or Be compound) is formed. To be more specific, precipitation hardening of Be (or Be compound) contained in the rectangular copper alloy 200 occurs by holding the rectangular copper alloy 200 in a precipitation temperature range (within a range from 200° C. to 550° C.) for given age hardening time (1 hour to 24 hours).

(Operation and Effects)

According to the method for producing beryllium-copper according to the embodiment of the present invention, by adding plastic strain to beryllium-copper within a processing temperature range with which Be is not precipitated, generation of an oxidized scale can be suppressed.

Moreover, by applying plastic strain to beryllium-copper (the rectangular copper alloy 200) over multiple times, an amount of plastic strain applied to the beryllium-copper (an accumulated amount of strain) is increased, and beryllium-copper having uniform and fine crystal grains (an average grain size≦2 μm) can be produced without strictly controlling processing temperature and processing time.

To be more specific, since pressure is applied to the rectangular copper alloy from the X axis direction, Y axis direction, and Z axis direction so that the amount of strain added by a single pressurization in the processing temperature range (within the range from 0° C. to 200° C.) is within a range from 0.3 to 0.7, the accumulated amount of strain can be increased without processing the rectangular copper alloy at processing temperature (for example, 300° C.) and for processing time (for example, 30 minutes or shorter) which are strictly controlled.

In other words, because the processing temperature range is wide and is lower than conventional ranges, beryllium-copper having uniform and fine crystal grains (the average grain size≦2 μm) can be produced while suppressing possibilities of breakage of the rectangular copper alloy, advancing age hardening of the rectangular copper alloy, and the like, due to intermediate temperature embrittlement.

Moreover, by adding plastic strain to the rectangular copper alloy 200 before age hardening processing is performed, it becomes possible to avoid a difficulty in adding plastic strain as age hardening advances.

Here, "the average grain size≦2 μm" refers to an average grain size measured by the following measurement method.

(1) Conduct crystal orientation analysis using a SEM/EBSP (scanning electron microscope/electron back scatter diffraction pattern) method, and count boundaries with an orientation deviation θ of 2° or larger as crystal grain boundaries to obtain a distribution of crystal grain sizes.

(2) Confirm that the average orientation deviation θ of the total count is 15° or larger.

(3) Calculate an average grain size from the distribution of crystal grain sizes.

In general, structures made only by sub-grains having an orientation deviation of $0° \leqq \theta < 4°$ are not counted as crystal grains. However, in this embodiment, since an observation result is a capture of an arbitrary moment of a process of super miniaturization, structures made only by sub-grains having an orientation deviation of $0° \leqq \theta < 4°$ are also considered a part of the entire structure at that moment. Therefore, structures having an orientation deviation of 15° or larger are counted as crystal grains.

EXAMPLES

Herein below, an evaluation result of beryllium-copper according to the embodiment of the present invention is described with reference to the drawings.

Specifically, as beryllium-copper according to the embodiment of the present invention, a rectangular copper alloy structured with a weight ratio (%) of $Cu_{97.77}Be_{0.35}Ni_{1.88}$ was used. Further, the rectangular copper alloy was a rectangular parallelepiped having sides extending in directions of three axes which are orthogonal to each other, and the length ratio of the sides of the rectangular copper alloy (X side:Y side:Z side) was 1:1.22:1.5.

Moreover, a rectangular pure copper containing Cu at a weight ratio of 99% or higher was used as a comparative material for the beryllium-copper according to the embodiment of the present invention. Further, the rectangular pure copper has a similar size as the rectangular copper alloy described above.

As for the rectangular copper alloy, Be and Ni were dissolved into Cu matrix in advance by solid solution processing. To be more specific, a rectangular copper alloy was vacuum-encapsulated into a quartz tube, and the rectangular copper alloy vacuum-encapsulated into the quartz tube was held under heating at 950° C. for 24 hours, and then water hardening was performed. As a result, the average grain size of crystal grains of the rectangular copper alloy was approximately 160 μm.

On the other hand, the rectangular pure copper was held under heating within a vacuum furnace at 500° C. for 30 minutes, and then annealing was performed. As a result, the average grain size of crystal grains of the rectangular pure copper was approximately 70 μm.

Moreover, as for the rectangular cooper alloy, plastic strain was added by applying pressure from the directions of three axes (X axis, Y axis, and Z axis) which are orthogonal to each other by using the casting apparatus 100 at processing temperature (27° C.). Specifically, plastic strain was added to the rectangular copper alloy at a strain speed of $3.0 \times 10^{-3}\ s^{-1}$, and the plastic strain was added so that an amount of strain by single pressurization was 0.4.

Further, as for the rectangular copper alloy, after water hardening is performed within 2 seconds after pressurization from the direction of each of the axes (Y axis, Y axis and Z axis), polishing was conducted. After the polishing is finished, the rectangular copper alloy was held under heating at processing temperature (27° C.) for 15 to 18 minutes, and pressurized again from the direction of each of the axes (X axis, Y axis and z axis) to add plastic strain. Moreover, the series of these operations were repeated until the accumulated value of plastic strain (the accumulated amount of strain: $\epsilon_{total}$) reached 6, and measurement of work hardening over time, measurement of hardness, observation of structures by an optical microscope, and observation of structures using the SEM/EBSP (scanning electron microscope/electron back scatter diffraction pattern) method were conducted.

Figure 5:
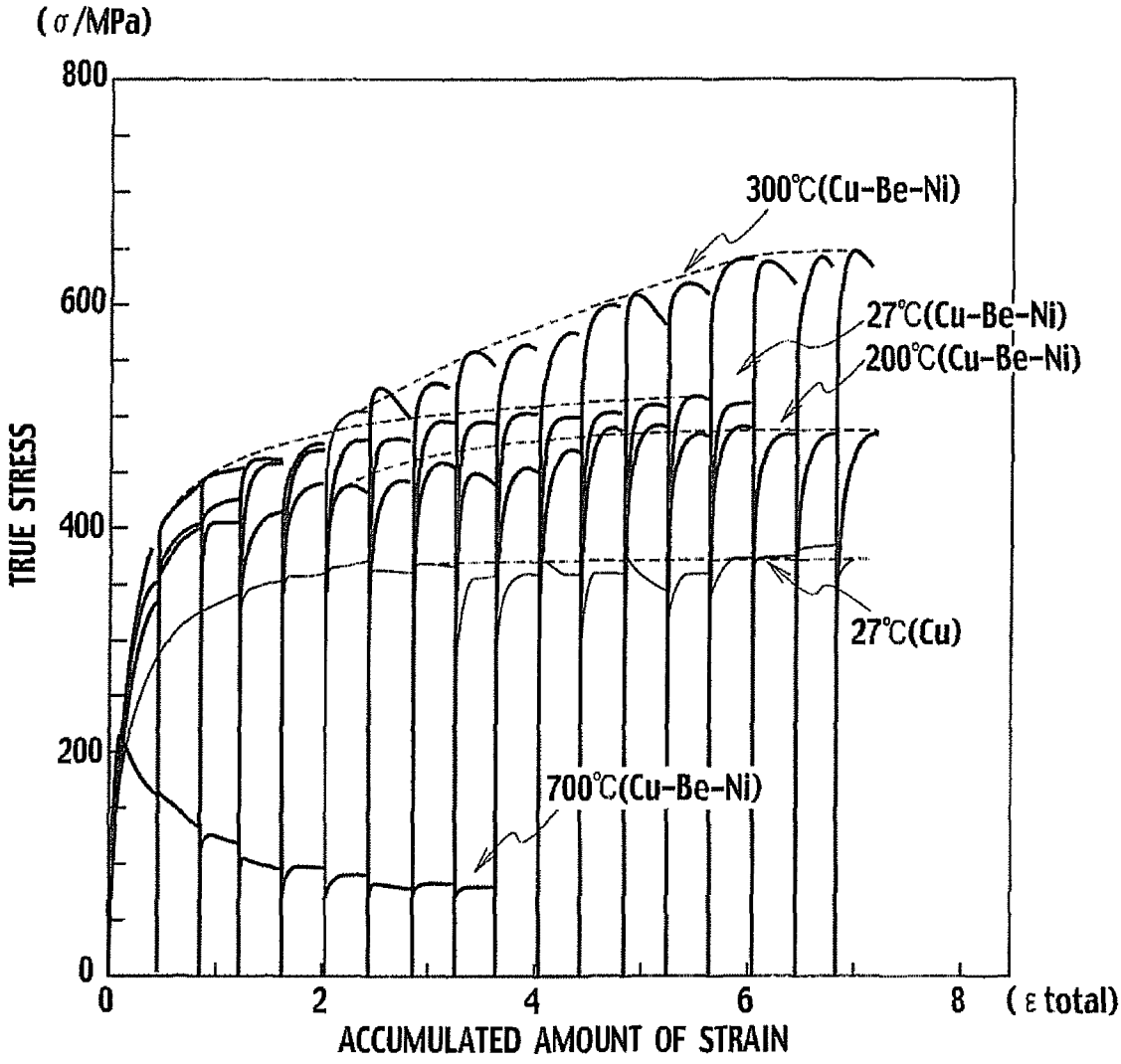
FIG. 5 is a view illustrating results of comparison between rectangular copper alloys and rectangular pure copper according to the embodiment of the present invention (No. 1)

Herein below, a result of comparison between work hardening of the rectangular copper alloy (Cu—Be—Ni) according to the embodiment of the present invention, and work hardening of the rectangular pure copper (Cu) is described with reference to the drawing. FIG. 5 is a view showing the result of comparison between work hardening of the rectangular copper alloy (Cu—Be—Ni) according to the embodiment of the present invention, and work hardening of the rectangular pure copper (Cu).

As shown in FIG. 5, in the case of the rectangular pure copper (Cu, processing temperature=27° C.), a true stress thereof was rapidly increased until the accumulated amount of strain becomes 1 from 0 (work hardening advanced), and the true stress was gently increased until the accumulated amount of strain became 2 from 1. Further, the true stress became constant once the accumulated amount of strain reached 2 or higher.

On the other hand, in the case of the rectangular copper alloy (Cu—Se—Ni), a true stress thereof was rapidly increased until the accumulated amount of strain became 1.5 from 0 (work hardening advanced), and the true stress kept increasing gently even after the accumulated amount of strain became 2 or higher.

Further, when the working temperature was 27° C., a steady-state deforming stress of the rectangular pure copper (cu) was 380 MPa, while a steady-state deforming stress of the rectangular copper alloy (Cu—Be—Ni) was over 500 MPa.

Figure 6:
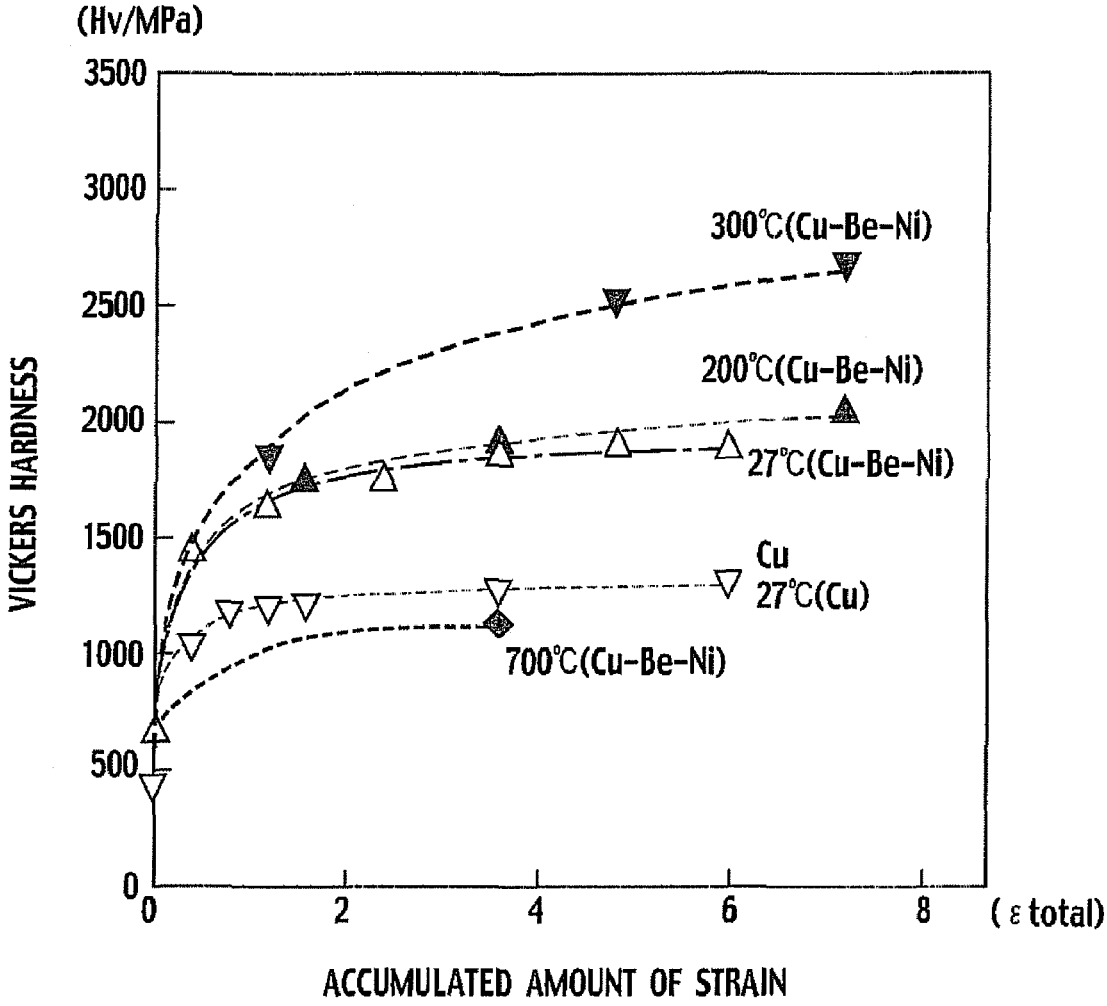
FIG. 6 is a view illustrating results of comparison between a rectangular copper alloy and rectangular pure copper according to the embodiment of the present invention (No. 2)

Herein below, a result of comparison between hardness of the rectangular copper alloy (Cu—Be—Ni) according to the embodiment of the present invention, and hardness of the rectangular pure copper (Cu) is described with reference to the drawing. FIG. 6 is a view showing the result of comparison between hardness of the rectangular copper alloy (Cu—Be—Ni) according to the embodiment of the present invention, and hardness of the rectangular pure copper (Cu).

As shown in FIG. 6, it was revealed that a relationship between Vickers hardness and the accumulated amount of strain tends to have a similarity to a relationship between the true strain and accumulated amount of strain shown in FIG. 5.

Specifically, in the case of the rectangular pure copper (Cu, processing temperature=27° C.), the Vickers hardness was rapidly increased until the accumulated amount of strain became 1 from 0 (work hardening advanced) and the Vickers hardness was increased gently until the accumulated amount of strain became 2 from 1. Further, once the accumulated amount of strain reached 2 or higher, the Vickers hardness became constant.

Meanwhile, in the case of the rectangular copper alloy (Cu—Be—Ni), the Vickers hardness was rapidly increased until the accumulated amount of strain became 1.5 from 0 (work hardening advanced), and the Vickers hardness kept increasing gently even after the accumulated amount of strain reached 2 or higher.

Figure 7:
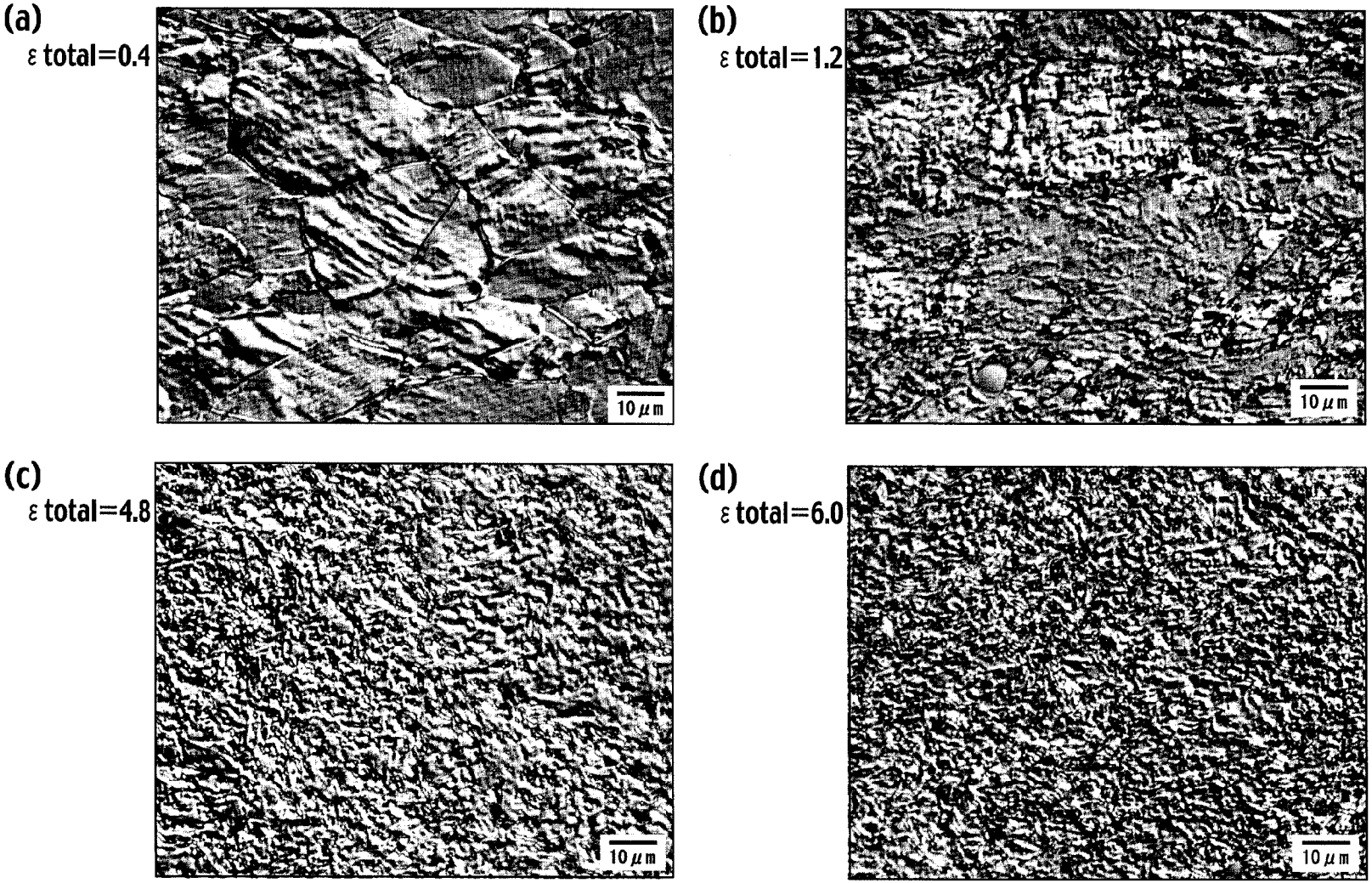
FIG. 7 is a view illustrating results of observation the structures of the rectangular copper alloy by using an optical microscope according to the embodiment of the present invention.

Herein below, the rectangular copper alloy (Cu—Be—Ni) according to the embodiment of the present invention is described with reference to the drawings. FIGS. 7(*a*) to 7(*d*) are views showing results of the structure observation using an optical microscope for the crystal grains of the rectangular copper alloy (Cu—Be—Ni) according to the embodiment of the present invention. Further, FIGS. 8(*a*) to 8(*d*) are views showing the results of the structure observation using the SEM/EBSP method for the crystal grains of the rectangular copper alloy (Cu—Be—Ni) according to the embodiment of the present invention.

Figure 8:
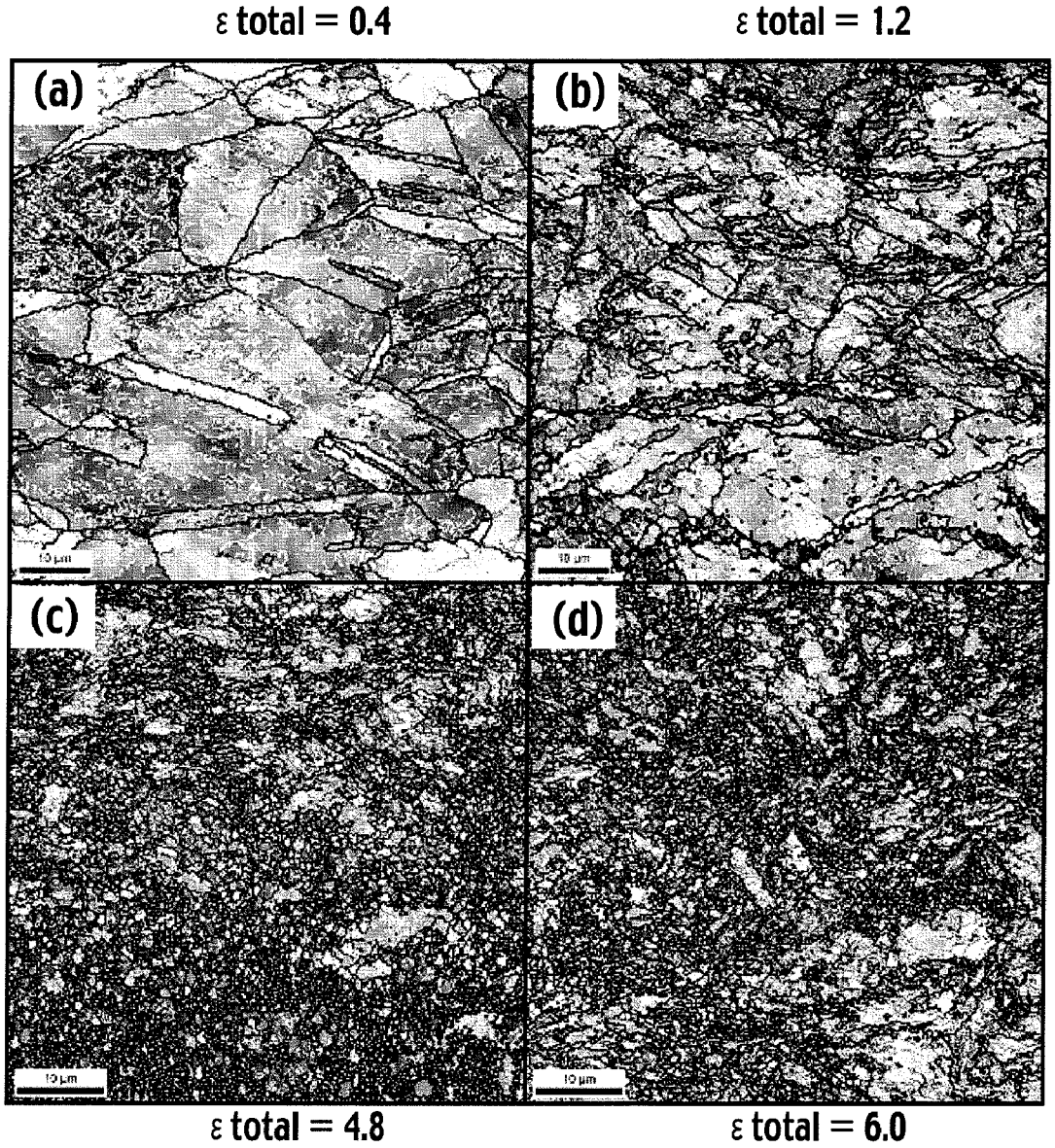
FIG. 8 is a view illustrating results of observation using the SEM/EBSP method for the structure of the rectangular copper alloy according to the embodiment of the present invention.

Note that FIGS. 7(*a*) to 7(*d*) and FIGS. 8(*a*) and 8(*d*) show the results of observation of the structures of crystal grains of the rectangular copper alloy (Cu—Be—Ni) in the cases where the accumulated amount of strain ($\epsilon_{total}$) was 0.4, 1.2, 4.8, and 6.0.

Here, a sample of the rectangular copper alloy, of which structures were observed by the optical microscope, was made by cutting the rectangular copper alloy on a surface parallel with the direction of an axis in which pressure was last added to the rectangular copper alloy, and polishing the cut surface of the rectangular copper alloy into a mirror like state by emery paper polishing, buffing, and electro polishing, and thereafter performing electrolytic etching (electro-polishing solution:phosphoric acid=50%+distilled water=50%).

Meanwhile, a sample of the rectangular copper alloy of which structures were observed by the SEM/EBSP method was made by cutting the rectangular copper alloy on a surface parallel with the direction of an axis in which pressure was last added to the rectangular copper alloy, and polishing the cut surface of the rectangular copper alloy by emery paper polishing, buffing, and electro polishing (electro-polishing solution:methanol=198 ml+phosphoric acid=135 ml).

As shown in FIG. 7(*a*), when the accumulated amount of strain ($\epsilon_{total}$) was 0.4, deformation bands started to appear within the crystal grains generated in an initial stage (hereinafter refereed to as initial crystal grains). As shown in FIG. 7(*b*), when the accumulated amount of strain ($\epsilon_{total}$) was 1.2, the density of the deformation bands generated in the initial crystal grains increased. As shown in FIG. 7(*c*), when the accumulated amount, of strain ($\epsilon_{total}$) was 4.8, the deformation bands were generated in the entire areas of the initial crystal grains, and the initial crystal grains were no longer identifiable. In other words, fine granular structure (the average grain size≦2 μm) was generated all over the initial crystal grains. As shown in FIG. 7(*d*), when the accumulated amount of strain ($\epsilon_{total}$) was 6.0, the density of the deformation bands generated in the initial crystal grains became even higher.

As shown in FIG. (8*a*), when the accumulated amount of strain ($\epsilon_{total}$) was 0.4, dislocation boundaries were generated within the initial crystal grains with an orientation deviation of 0° to 15°. As shown in FIG. 8(*b*), the dislocation boundaries were generated within the initial crystal grains with an orientation deviation of 0° to 15°, and fine granular structures were generated in the vicinity of the boundaries of the initial crystal grains. As shown in FIG. 8(*c*), when the accumulated amount of strain ($\epsilon_{total}$) was 4.8, the dislocation boundaries were generated over the entire areas of the initial crystal grains with an orientation deviation of 0° to 15°, and fine granular structures (the average grain size≦2 μm) were generated all over the initial crystal grains. At this stage, a big angle tilt grain boundaries in which the orientation deviation of the dislocation boundaries is from 0° to 5° were hardly observed. As shown in FIG. 8(*d*), when the accumulated amount of strain ($\epsilon_{total}$) was 6.0, the dislocation boundaries were generated over the entire areas of the initial crystal grains with an orientation deviation of 0° to 15° similarly to the case where the accumulated amount of strain ($\epsilon_{total}$) was 4.8, and fine granular structures (the average grain size≦2 μm) was generated all over the initial crystal grains.

Figure 9:
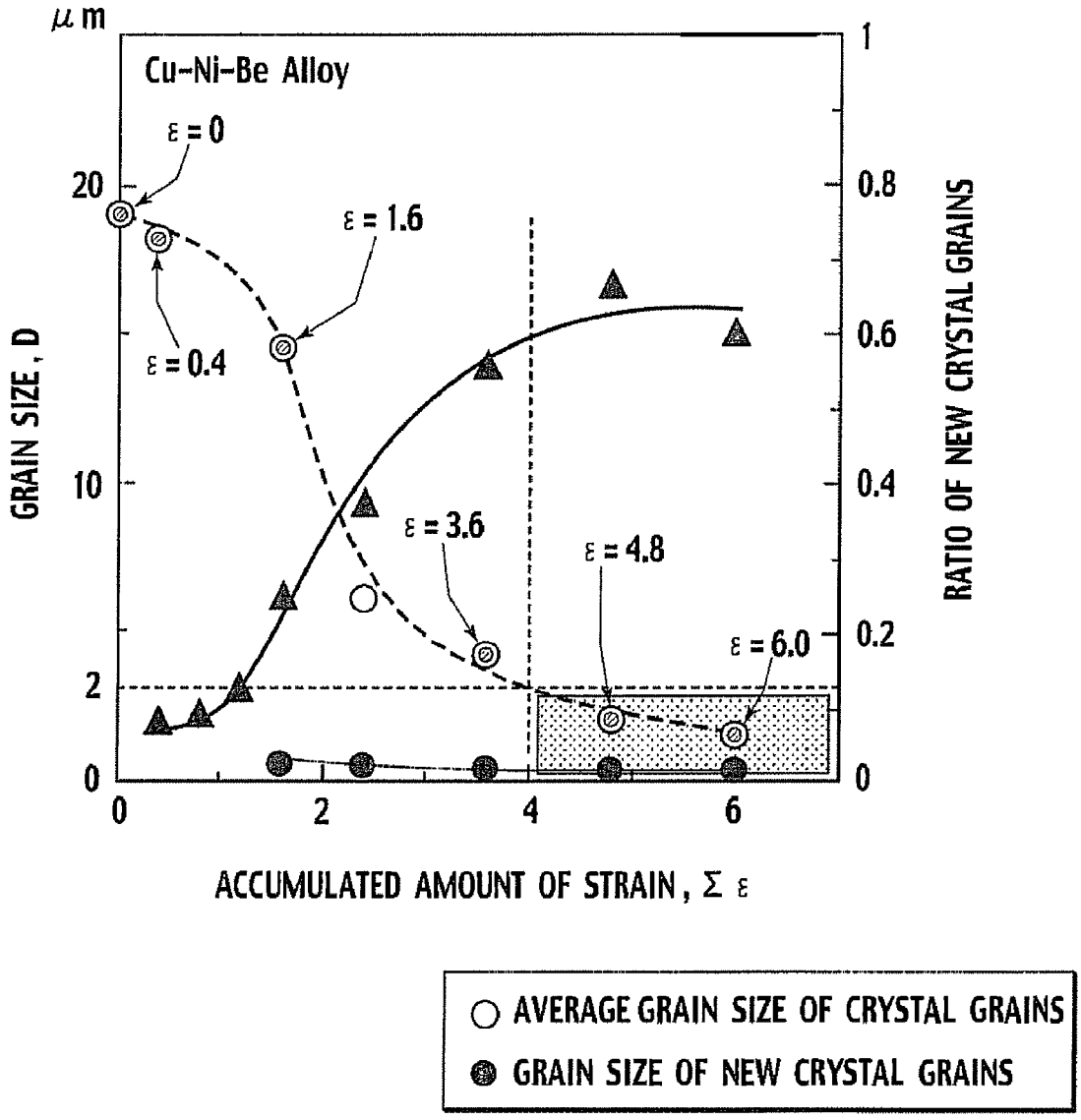
FIG. 9 is a view illustrating a relationship between an average grain size and an accumulated amount of strain of the rectangular copper alloy according to the embodiment of the present invention.
Figure 10:
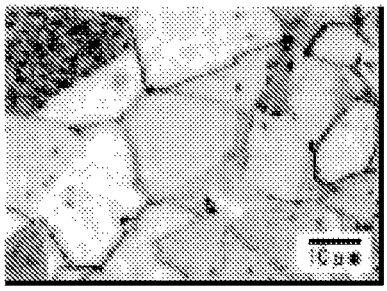
FIG. 10 is a view illustrating results of observation using the SEM/EBSP method for the rectangular copper alloy according to the embodiment of the present invention.
Figure 10:
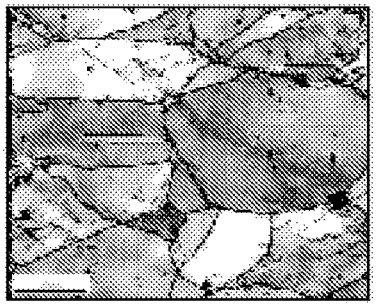
Figure 10:
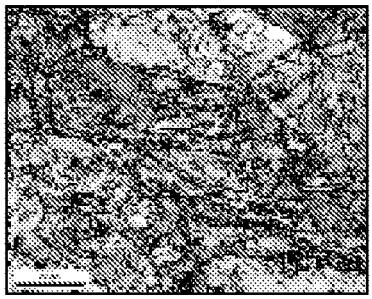
Figure 10:
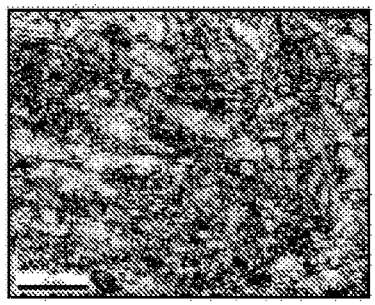
Figure 10:
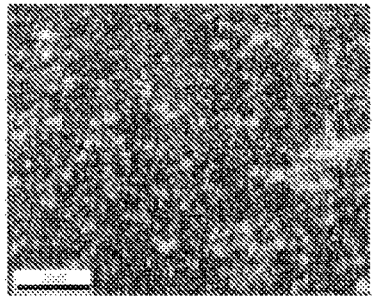
Figure 10:
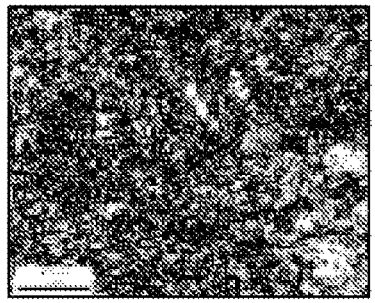

Herein below, a relationship between an average grain size and an accumulated amount of strain of the rectangular copper alloy (Cu—Be—Ni) according to the embodiment of the present invention is described with reference to the drawings. FIG. 9 is a view showing a relationship between an average grain size and an accumulated amount of strain of the rectangular copper alloy (Cu—Be—Ni) according to the embodiment of the present invention. FIGS. 10(*a*) to 10(*f*) are views showing the results of observation using the SEM/EBSP method for crystal grains of the rectangular copper alloy (Cu—Be—Ni) according to the embodiment, of the present invention.

As shown in FIG. 9, it was confirmed that as the accumulated amount of strain ($\Sigma\epsilon$) increases, the average grain size of the crystal grains of the rectangular copper alloy decreases. Moreover, almost no changes were observed in grain sizes of crystal grains generated by adding plastic strain to the rectangular copper alloy (new crystal grains). Further, it was confirmed that as the accumulated amount of strain ($\Sigma\epsilon$) increases, a ratio of the new crystal grains within the rectangular copper alloy increases.

Furthermore, it was found that the average grain size of the crystal grains of the rectangular copper alloy became 2 μm or smaller when the accumulated amount of strain ($\Sigma\epsilon$) is 4 or more.

As shown in FIGS. 10(*a*) to 10(*f*), it was found that when the accumulated amount of strain ($\Sigma\epsilon$) is 4.8, the new crystal grain boundaries were generated over the entire areas of the initial crystal grains with an orientation deviation of 0° to 15°, and fine granular structures (the average grain size≦2 μm) were generated all over the initial crystal grains, similarly to the case of FIGS. 8(*a*) to 8(*d*) described above.

Figure 11:
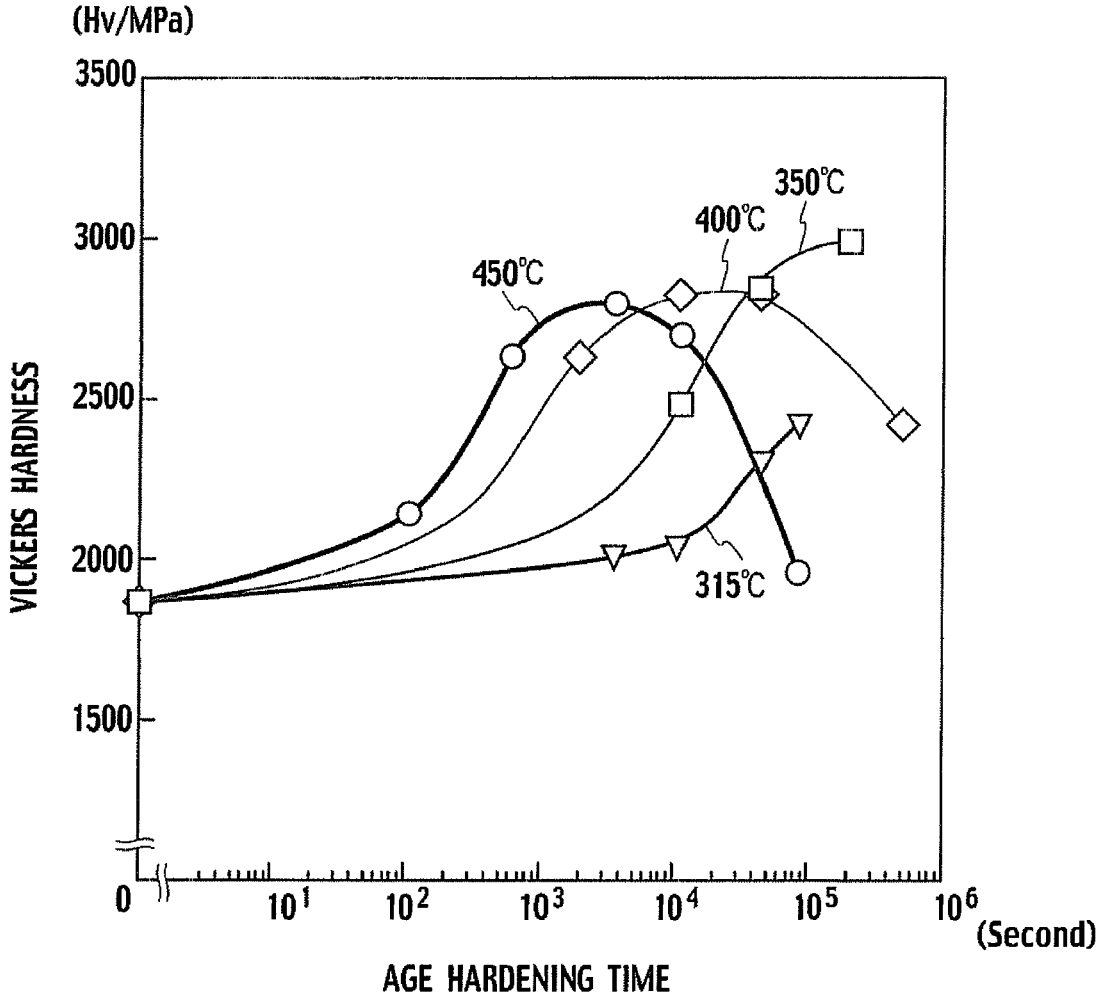
FIG. 11 is a view illustrating an evaluation result of the rectangular copper alloy according to the embodiment of the present invention (No. 1)
Figure 12:
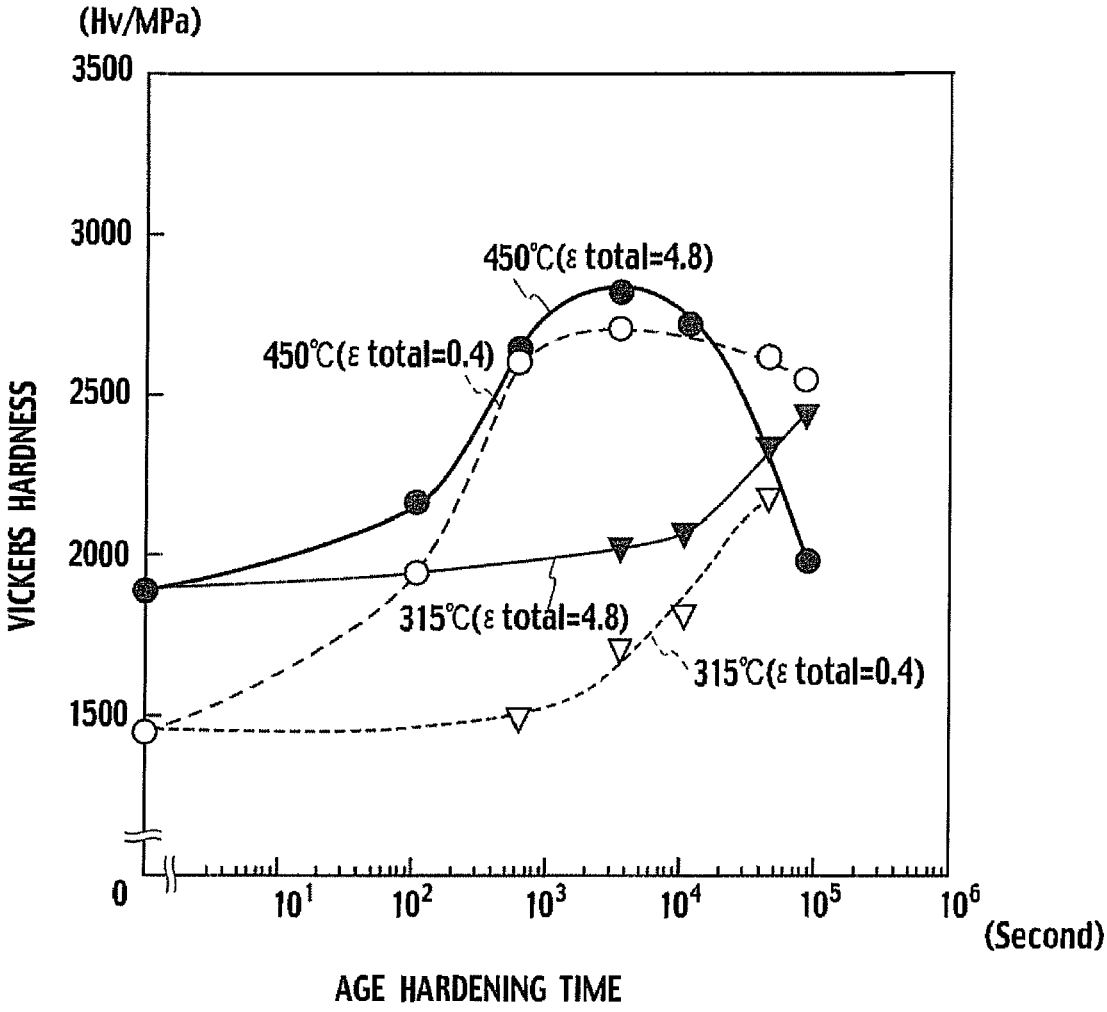
FIG. 12 is a view illustrating an evaluation result of the rectangular copper alloy according to the embodiment of the present invention (No. 2).

Herein below, age hardening of the rectangular copper alloy (Cu—Be—Ni) according to the embodiment of the present invention is described with reference to the drawings. FIGS. 11 and 12 are views showing age hardening of the rectangular copper alloy (Cu—Be—Ni) according to the embodiment of the present invention.

As shown in FIG. 11, when age hardening processing was performed at 450° C., the Vickers hardness of the rectangular copper alloy (Cu—Be—Ni) reached the maximum value (2,800 MPa) when the age hardening time reached about 1 hour. Meanwhile, when age hardening was performed at 315° C., the Vickers hardness of the rectangular copper alloy (Cu—Be—Ni) was over 2,400 MPa when the age hardening time reached about 20 hours.

Further, as shown in FIG. 12, the value of the Vickers hardness of the rectangular copper alloy (Cu—Be—Ni) with the accumulated amount of strain of 4.8 was higher than the Vickers hardness of the rectangular copper alloy (Cu—Be—Ni) with the accumulated amount of strain of 0.4.

Modified Example

According to the embodiment described above, plastic strain is added to the rectangular copper alloy (Cu—Be—Ni) by performing rolling processing through applying a pressure from the directions of three axes (X axis, Y axis, and Z axis) which are orthogonal to each other. However, the present invention is not limited to this, and other plastic processing (for example, extrusion processing) can be performed multiple times to add plastic strain to the rectangular copper alloy (Cu—Be—Ni).

What is claimed is:

1. A method for producing beryllium-copper containing at least Be and Cu, comprising:

holding the beryllium-copper for a predetermined solid solution time in a solid solution temperature range in which the Be is dissolved into the Cu;

cooling the beryllium-copper at a cooling speed at which the Be remains dissolved in the Cu;

applying plastic strain to a cooled beryllium-copper over multiple times in a processing temperature range in which the Be is not precipitated; and holding the beryllium-copper to which the plastic strain is applied for a predetermined age hardening time in a precipitation temperature range in which the Be is precipitated;

wherein the beryllium-copper to which the plastic strain is applied is a rectangular parallelepiped having sides which extend in directions of three axes which are orthogonal to each other, and a ratio of lengths of the sides extending in the directions of the three axes which are orthogonal to each other is 1:e:f ($1.2 \leqq e \leqq 1.3$, $1.45 \leqq f \leqq 1.55$), and wherein the applying step includes applying pressure to the beryllium-copper from each of the directions of the axes by turns, and an amount of the plastic strain applied to the beryllium-copper by a single pressurization is within a range from 0.3 to 0.7.

2. The method according to claim 1, wherein the beryllium-copper is structured with a weight ratio of $Cu_{100-(a-b)}Be_aCo_b$ ($0.4\% \leqq a \leqq 2.0\%$, $0.15\% \leqq b \leqq 2.8\%$, and $a+b \leqq 3.5\%$), or a weight ratio of $Cu_{100-(c-d)}Be_cNi_d$ ($0.05\% \leqq c \leqq 0.6\%$, $1.0\% \leqq d \leqq 2.4\%$, and $c+d \leqq 3.0\%$).

3. The method according to claim 1, wherein the solid solution temperature range is within a range from 700° C. to 1000° C., the predetermined solid solution time is within a range from 1 hour to 24 hours, the processing temperature range is within a range from 0° C. to 200° C., the precipitation temperature range is within a range from 200° C. to 550° C., and the predetermined age hardening time is within a range from 1 hour to 24 hours.

4. The method according to claim 1, wherein the applying step further comprises applying pressure to the beryllium-copper from each of the direction of the axes by turns until an accumulated value of the plastic strain applied to the beryllium-copper becomes 4 or more.

* * * * *